US007699424B2

(12) United States Patent
Shihoh et al.

(10) Patent No.: US 7,699,424 B2
(45) Date of Patent: Apr. 20, 2010

(54) INKJET PRINTING APPARATUS AND INKJET PRINTING METHOD

(75) Inventors: Makoto Shihoh, Yokohama (JP); Shoji Kanemura, Sagamihara (JP); Noriyuki Chino, Kawasaki (JP); Hiroyasu Nomura, Inagi (JP)

(73) Assignee: Canon Kabushiki Kaisha, Tokyo (JP)

( * ) Notice: Subject to any disclaimer, the term of this patent is extended or adjusted under 35 U.S.C. 154(b) by 257 days.

(21) Appl. No.: 11/954,518

(22) Filed: Dec. 12, 2007

(65) Prior Publication Data

US 2008/0143775 A1 Jun. 19, 2008

(30) Foreign Application Priority Data

Dec. 13, 2006 (JP) ..... 2006-336368

(51) Int. Cl.
*B41J 29/38* (2006.01)
*B41J 29/393* (2006.01)

(52) U.S. Cl. ..... 347/17; 347/11; 347/19

(58) Field of Classification Search ..... 347/17
See application file for complete search history.

(56) References Cited

U.S. PATENT DOCUMENTS 5,006,867 A * 4/1991 Koizumi et al. ..... 347/17
5,861,895 A 1/1999 Tajika et al.
2004/0179051 A1 * 9/2004 Tainer et al. ..... 347/11
2006/0214962 A1 * 9/2006 Takata ..... 347/14

FOREIGN PATENT DOCUMENTS

JP 5-31905 2/1993
JP 9-183222 7/1997
JP 2001-239655 9/2001

* cited by examiner

*Primary Examiner*—Matthew Luu
*Assistant Examiner*—Shelby Fidler
(74) *Attorney, Agent, or Firm*—Fitzpatrick, Cella, Harper & Scinto

(57) ABSTRACT

There is provided an inkjet printing apparatus having a printhead equipped with printing element row that includes printing elements having a plurality of heat-producing resistance elements. The apparatus includes a temperature sensing unit which senses the temperature of the printhead, a temperature distribution storage unit in which a temperature distribution along the printing element row, a temperature gradient calculating unit which calculates the temperature gradient of the printing element row from the temperature of the printhead sensed by the temperature sensing units, a predicting unit which predicts the temperature of each printing element using the temperature gradient and the temperature distribution along the printing element row, and a control unit which applies discharge pulses, which are decided based upon the predicted temperature from the predicting unit, to each of the printing elements.

6 Claims, 14 Drawing Sheets

PRIOR ART

PRIOR ART

FIG. 5

| TEMPERATURE | DISCHARGE PULSE NO. |
|---|---|
| 24～27 | 1 |
| 27～30 | 2 |
| 30～33 | 3 |
| 33～36 | 4 |
| 36～39 | 5 |
| 39～42 | 6 |
| 42～45 | 7 |
| 45～48 | 8 |
| 48～51 | 9 |
| 51～54 | 10 |

PRIOR ART

P4 : SHORT PULSE (=T4)

P1 : PREHEATING PULSE (=T1)
P2 : INTERVAL TIME (=T2-T1)
P3 : MAIN HEATING PULSE (=T3-T2)
Vop : DRIVING VOLTAGE

INKJET PRINTING APPARATUS AND INKJET PRINTING METHOD

BACKGROUND OF THE INVENTION

1. Field of the Invention

The present invention relates to an inkjet printing apparatus and inkjet printing method. More particularly, the invention relates to an inkjet printing apparatus and inkjet printing method for suppressing error in amount of ink discharge and suppressing a decline in image quality.

2. Description of the Related Art

In an inkjet printing apparatus proposed heretofore, a plurality of printheads each having a plurality of printing elements are fixedly arranged in parallel and are caused to scan across a print medium to print on the medium. A characterizing feature of an inkjet printing apparatus having such a construction is a printing speed higher than that of a so-called serial-scanning-type printing apparatus for printing by the scanning of a printhead.

A problem that arises in the attainment of a high printing speed is a decline in image quality ascribable to a fluctuation in amount of ink discharge due to a temperature rise in the printhead. Various types of control for stabilizing the amount of ink discharged from a printhead have been proposed for the purpose of minimizing the occurrence of density unevenness, etc., in printed images and the like (see the specifications of Japanese Patent Application Laid-Open Nos. 5-31905 and 9-183222).

In an inkjet printing method available in the art, an ink bubbling force is produced by applying electric pulses to a heat-producing resistance element (also referred to as a "heater"), thereby heating the ink rapidly and causing the ink to undergo a change in state from the liquid phase to the gas phase. With this printing method, the amount of ink discharge is substantially decided by the method of introducing energy up to the change in state of the ink from the liquid phase to the gas phase. Consequently, after the ink has undergone the change in state to the gas phase, there is almost no effect upon the amount of ink discharge regardless of how the energy is introduced.

One conventional measure for dealing with a fluctuation in amount of ink discharge ascribable to a temperature rise in an inkjet printing apparatus is to control the method of energy introduction up to the change in state to the gas phase. For example, there is a method of modulating the amount of ink discharge by using divided pulses of the kind shown in FIG. 9 and controlling a preheating pulse, main heating pulse and quiescent time (interval time) between these pulses.

FIG. 9 is a time chart of heating pulses applied to a printhead. The heating pulses used here are divided pulses and the pulse width thereof can be modulated.

Pulse width and driving voltage $V_{op}$ of the heating pulses for driving the printhead are decided by the area, resistance value and film structure of a heater board and the nozzle structure of the printhead.

In FIG. 9, reference characters P1, P2 and P3 denote a preheating pulse, interval time and a main heating pulse, respectively. The pulse waveform of at least one of P1, P2, and P3 is modulated based upon temperature information from a temperature sensor (a diode sensor, etc.) provided on the printhead. Further, reference characters T1, T2 and T3 represent the rise times of the applied pulses and indicate times for deciding P1, P2 and P3, respectively.

The preheating pulse P1 has a pulse width mainly for controlling ink temperature within a nozzle. This pulse width is controlled in accordance with temperature sensed utilizing the temperature sensor of the printhead. This pulse width is controlled in such a manner that the ink will not be caused to bubble by preheating owing to excessive application of thermal energy to the ink.

The interval time P2 is provided for the purpose of preventing mutual interference between the preheating pulse P1 and main heating pulse P3, and for the purpose of uniformalizing the temperature of the ink within the nozzle by causing the thermal energy applied by the preheating pulse P1 to spread into the ink at the portion above the heater.

The main heating pulse P3 subjects the ink to energy for bubbling the ink and discharging ink droplets from discharge ports.

In a case where a uniform image has been printed on the entire surface of the print medium, the temperature distribution along the row direction of the printing elements is not uniform, is high at the central portion of the row of printing elements and low at both ends thereof. In particular, at the end of printing when the temperature rise is great, this tendency becomes conspicuous, as indicated by the curve "ACTUAL TEMPERATURE DISTRIBUTION" in FIG. 2A. It should be noted that FIG. 2A is the temperature distribution of a row of printing elements at the end of printing in a case where a uniform image has been printed on the entire surface of the printing medium.

As a consequence of this non-uniform temperature distribution, the density of the image printed by the printing elements at the central portion of the row of printing elements exceeds the density of the image printed by the printing elements at both ends of the row, despite the fact that the intent was to print an image of uniform density. This invites a decline in image quality.

A conceivable method of controlling the amount of ink discharge in such cases is to hold the amount of ink discharge from each printing element substantially constant by selecting an optimum discharge pulse for each printing element in accordance with the temperature distribution along the row direction of the printing elements.

For example, in FIG. 2A, the amount of ink discharge is controlled using three types of discharge pulses with respect to the curve "TACTUAL TEMPERATURE DISTRIBUTION". Discharge pulses from a Pulse Width Table No. 3 in FIG. 13 are used for the printing elements in areas A and E, in FIG. 2A. Since the printing elements in areas B and D have a higher temperature than that of the printing elements in areas A and E, discharge pulses from a Pulse Width Table No. 4 are used to suppress an increase in amount of ink discharge. Since printing elements in area C have an even higher temperature, discharge pulses from a Pulse Width Table No. 5 are used.

If the step-shaped line drawing labeled "DISCHARGE-PULSE SET TEMPERATURE DISTRIBUTION" in FIG. 2A is the temperature distribution along the row direction of the printing elements, the amount of discharge of ink droplets from the entire row of printing elements will be fixed, but the actual temperature distribution is the line drawing "ACTUAL TEMPERATURE DISTRIBUTION". Accordingly, FIG. 2B is a diagram illustrating the temperature difference between the line drawing "ACTUAL TEMPERATURE DISTRIBUTION" and the line drawing "DISCHARGE-PULSE SET TEMPERATURE DISTRIBUTION". FIG. 2B represents temperature error along the row of printing elements. According to FIG. 2B, the error has a width W2 centered on zero.

This error in amount of ink discharge can be reduced by increasing the types of discharge pulses used and changing the discharge pulses finely in accordance with the change in temperature. Accordingly, it will suffice to decide the number of types of discharge pulses in such a manner that the error in amount of discharge will fall within an allowable range. The allowable range of error in amount of ink discharge is decided depending upon whether a change in image density can be visually discerned, by way of example.

However, since a printed image is not always an image having a uniform density along the direction of the row of printing elements, the temperature distribution also is not necessarily as indicated by the curve "ACTUAL TEMPERATURE DISTRIBUTION" in FIG. 2A. For example, in a case where an image is printed using only some printing elements as in FIG. 7B, the temperature distribution of the printing elements in the direction of the row of printing elements becomes as indicated by line drawing A in FIG. 7A. Further, in a case where an image having a smaller width and a density that is lower than that of the image of FIG. 7B is printed as in FIG. 7C, the temperature distribution becomes as indicated by line drawing B in FIG. 7A. Although both curves indicate temperature distributions that are clearly different, the temperatures measured by temperature sensors at both ends are equal. When these two types of images originally having different temperature distributions are printed, how the discharge pulses are applied should differ as a matter of course. However, this cannot be distinguished because the temperatures measured by the temperature sensors are the same.

Thus, although various temperature distributions arise in actuality, it is difficult to predict these temperature distributions. For this reason, it has been contemplated to stabilize temperature by applying heating pulses having pulse widths in ranges that will not cause the discharge of ink to heaters other than heaters currently used in printing, in such a manner that a temperature difference will not arise among printing elements within the row of printing elements (see the specification of Japanese Patent Laid-Open No. 2001-239655).

FIG. 8 illustrates a heating pulse for performing heating (short-pulse heating) by a pulse within a range that will not produce a discharge of ink. The pulse width of a short pulse P4 is set to be shorter than a discharge pulse for performing ordinary printing.

A pulse within a range that will not produce a discharge of ink signifies a pulse that does not apply enough energy to cause ink to be discharged. A short pulse involves less consumed energy in comparison with a discharge pulse. In the case of a discharge pulse, however, heat is released by the ink droplet discharged. It is understood, therefore, that the energy that contributes to the head temperature rise from a pulse just small enough not to discharge ink is substantially equal to the energy that contributes to the head temperature rise from a discharge pulse.

Accordingly, if during printing the short pulse P4 is applied to heaters other than heaters used in printing (heaters to which a discharge pulse is applied), pulses equal to those of a fully uniform image can be applied for any image whatsoever. As a result, a temperature distribution similar to that of the curve "ACTUAL TEMPERATURE DISTRIBUTION" can be obtained at all times.

However, even in a case where the pulse applied is equal to that in a case where a uniform image has been printed over the entire surface of the printing medium, the temperature of the printing elements in the row direction of the printing elements is high for the printing elements at the central portion of the row of printing elements and low for the printing elements at both ends of the row, as mentioned above. In particular, at the end of printing when the temperature rise is great, this tendency becomes conspicuous, as indicated by the curve representing "ACTUAL TEMPERATURE DISTRIBUTION" in FIG. 2A.

As a result, even in a case where the same discharge pulse is applied to each printing element in order to perform the printing of an image having a uniform density, the density of the image printed by the printing elements at the central portion of the row of printing elements exceeds the density of the image printed by the printing elements at both ends of the row. Such a difference in density causes a decline in image quality.

In the prior art, as set forth above, there is no disclosure of a technique for preventing a fluctuation in amount of ink discharge satisfactorily, the fluctuation being ascribable to a rise in the temperature of the printing elements of the printhead.

In a case where an image having a uniform density is formed over the entire surface of the print medium, it is believed that the temperature distribution along the direction of the row of printing elements has left-right symmetry, as illustrated in FIG. 2A, and that the temperatures measured at both ends of the row of printing elements by two temperature sensors provided at both ends are equal. The reason for this is that the energy for heating the heaters is applied to each of the printing elements substantially uniformly. In actuality, however, it has been found that owing to uneven thickness, etc., of the bonding agent that bonds a printing element board and support board that construct the printhead, the temperature distribution becomes one that has left-right asymmetry, as illustrated in FIG. 3A, and hence there are instances where the temperatures measured by the two temperature sensors differ.

In this case, in a manner similar to that of FIG. 2A, three types of discharge pulses are decided based upon the average value of the temperatures measured by the two temperature sensors. When this is done, the line drawing labeled "DISCHARGE-PULSE SET TEMPERATURE DISTRIBUTION"; shifts greatly from the line drawing "ACTUAL TEMPERATURE DISTRIBUTION" especially near both ends of the row of printing elements, as illustrated in FIG. 3A. Consequently, the temperature difference between the line drawing "ACTUAL TEMPERATURE DISTRIBUTION" and the line drawing "DISCHARGE-PULSE SET TEMPERATURE DISTRIBUTION" increases, as illustrated in FIG. 3B. As illustrated in FIG. 3B, a value W3 indicating the width of the error is larger than the value W2 of the width of the error described in conjunction with FIG. 2B. The greater the temperature difference, i.e., the temperature error, the greater the fluctuation in amount of ink discharge. As a result, density unevenness becomes conspicuous and the quality of the image declines.

In particular, it is known that when use is made of a printhead having a plurality of printing element boards and the boards are placed in staggered fashion in such a manner that ends of the rows of printing elements slightly overlap each other, the decline in image quality becomes very noticeable. The reason for this is that owing to a fluctuation in amount of ink discharge at the ends of each row of printing elements, a difference in density at the portions of the image formed by the boundaries between the printing element boards becomes readily visually discernable and conspicuous.

SUMMARY OF THE INVENTION

The present invention provides an inkjet printing apparatus and method for suppressing a fluctuation in amount of ink discharge caused by a rise in the temperature of the printing elements of a printhead, thereby effectively suppressing a decline in image quality.

According to an aspect of the present invention, there is provided an inkjet printing apparatus having a printhead equipped with printing element row that includes printing elements having a plurality of heat-producing resistance elements, comprising:

a temperature sensing unit, which is provided at least on both sides of the printing element row in the array direction thereof and senses the temperature of the printhead;

a temperature distribution storage unit in which a temperature distribution along the printing element row assumed when printing has been performed by driving the printing elements has been stored in advance;

a temperature gradient calculating unit which calculates the temperature gradient of the printing element row from the temperature of the printhead sensed by the temperature sensing units;

a predicting unit which predicts the temperature of each printing element using the temperature gradient calculated by the temperature gradient calculating unit and the temperature distribution along the printing element row stored in the temperature distribution storage unit in advance; and a control unit which applies discharge pulses, which are decided based upon the predicted temperature from the predicting unit, to each of the printing elements.

According to another aspect of the present invention, there is provided an inkjet printing method using an inkjet printing apparatus having a printhead equipped with printing element row that includes printing elements having a plurality of heat-producing resistance elements, a temperature sensing unit, which is provided at least on both sides of the printing element row in the array direction thereof and senses the temperature of the printhead, and a storage unit in which a plurality of discharge pulses for being applied to the printing elements have been stored in advance, the method comprising the steps of:

previously storing a temperature distribution along the printing element row assumed when printing has been performed by driving the printing elements;

sensing the temperature of the printhead by the temperature sensing unit;

calculating the temperature gradient of the printing element row from the temperature of the printhead sensed at the step of sensing temperature;

predicting the temperature of each printing element using the temperature gradient calculated at the step of calculating temperature gradient and the temperature distribution along the printing element row stored at the step of previously storing temperature distribution; and applying discharge pulses, which are decided based upon the predicted temperature predicted at the step of predicting temperature, to each of the printing elements.

Further features of the present invention will become apparent from the following description of exemplary embodiments with reference to the attached drawings.

BRIEF DESCRIPTION OF THE DRAWINGS

FIG. 5 is a diagram illustrating a table of discharge pulses for every temperature;

DESCRIPTION OF THE EMBODIMENT

A preferred embodiment of the present invention will now be described.

In the embodiment set forth below, a printer will be described as an example of a printing apparatus that uses the inkjet printing method.

In this specification, the term "print" expresses not only a case where significant information such as characters and graphics is formed but also broadly a case where images, designs and patterns, etc., are formed on a print medium regardless of whether these are significant or not. In addition, a processing of the medium is also included in the term "printing". Further, it does not matter whether or not the image manifests itself in such a manner it can be visually perceived by a human being.

Further, the term "print medium" expresses not only paper used in an ordinary printing apparatus but also broadly any medium capable of accepting ink, such as cloth, plastic film, a metal plate, glass, ceramics wood and leather.

Further, the term "ink" should be interpreted broadly in a manner similar to the definition of "printing" set forth above, and refers to a liquid which, by being applied to a printing medium, forms an image, design or pattern, etc., processes the medium or is capable of undergoing ink treatment. An example of ink treatment is the solidification or insolubilization of a color material in ink applied to the printing medium.

Furthermore, "actual temperature distribution" signifies not only the actual temperature distribution of a row of printing elements but also the temperature distribution of a row of printing elements deduced from the temperature of a printhead sensed by a temperature sensor.

Figure 10:
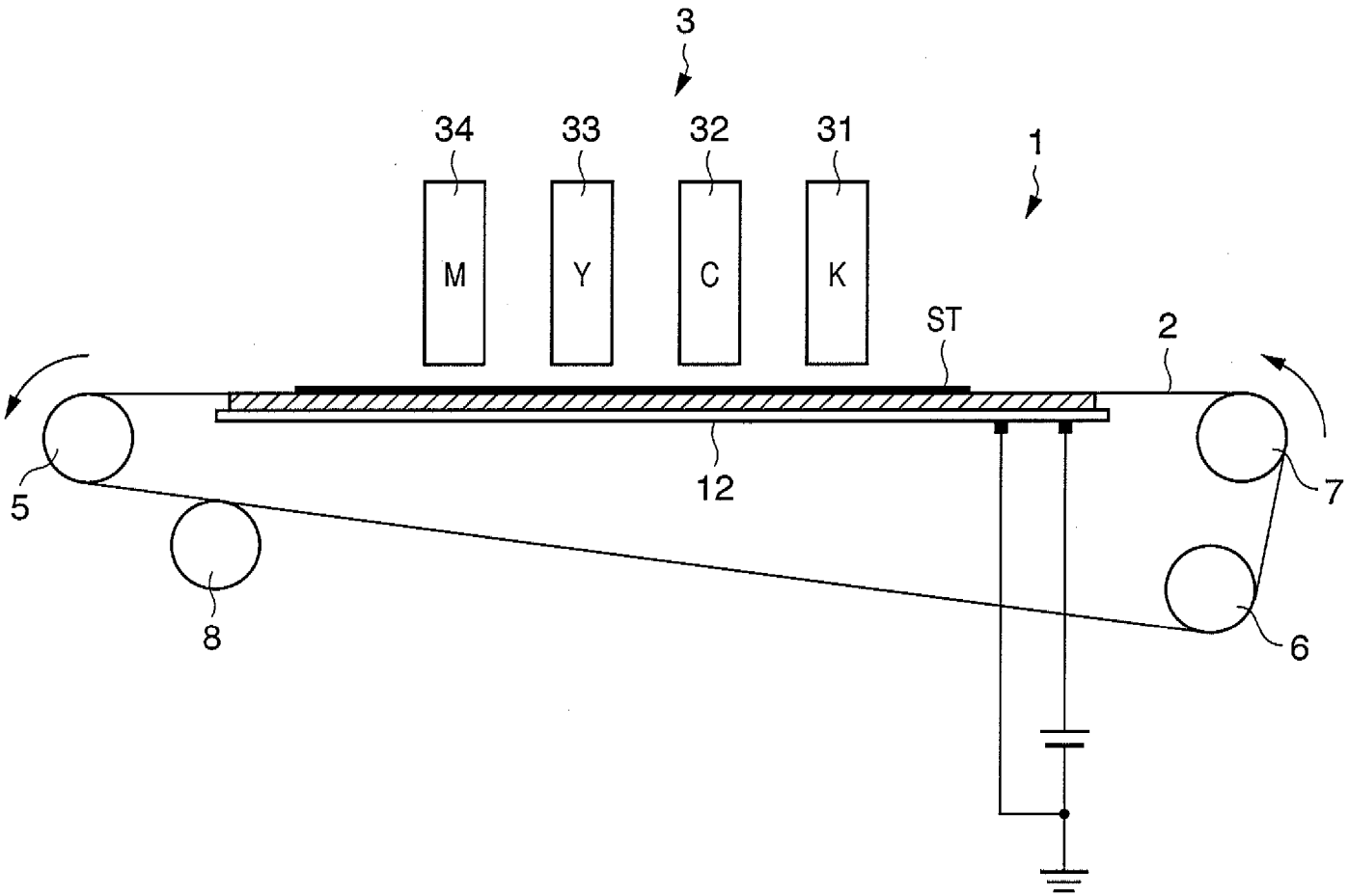
FIG. 10 is a sectional view illustrating the schematic structure of an inkjet printing apparatus.

FIG. 10 is a sectional view illustrating the schematic structure of an inkjet printing apparatus 1 according to a typical example of the present invention. As shown in FIG. 10, a printhead 3 has four printheads 31 to 34 for discharging inks of colors black (K), cyan (C), yellow (Y) and magenta (M) in this embodiment. These printheads are driven by a controller (described later) and discharge ink droplets of the corresponding inks to thereby perform color printing.

A sheet-like printing medium (referred to simply as a "sheet" below) ST is fed from a feeding unit (not shown) and is electrostatically adsorbed onto a conveying belt 2. The sheet ST is printed on when it passes below the printhead 3 while it is being moved. The conveying belt 2 serving as a conveying device is a ring-shaped belt tensioned by a conveying-belt drive roller 5 and support rollers 6, 7. The conveying belt 2 conveys the sheet ST by being circulated.

A cleaning mechanism 8 for the conveying belt 2 removes ink that has attached itself to the belt. There is a correlation between the amount of ink discharge and the temperature of the printhead 3. More specifically, the amount of ink discharge increases at a substantially constant rate with respect to the temperature of the printhead 3 generally over a temperature range 15 to 65° C. Accordingly, changing the shape of the heating pulses applied to the heat-producing resistance elements (heaters) in accordance with the temperature of the printhead 3 is an effective means for holding the amount of ink discharge constant. If, in a case where an image having a high ink-dot density has been formed on the entire surface of the sheet ST, heating pulses of the same pulse width are applied and discharge of ink is performed repeatedly, the temperature of the printhead 3 gradually rises, the amount of ink discharge from each printing element increases and, as a result, image density rises. Accordingly, if the temperature rise of the printhead 3 is sensed and the pulse width of the heating pulses is changed over at a certain point, then a correction can be made for the increase in amount of ink discharge.

Figure 11:
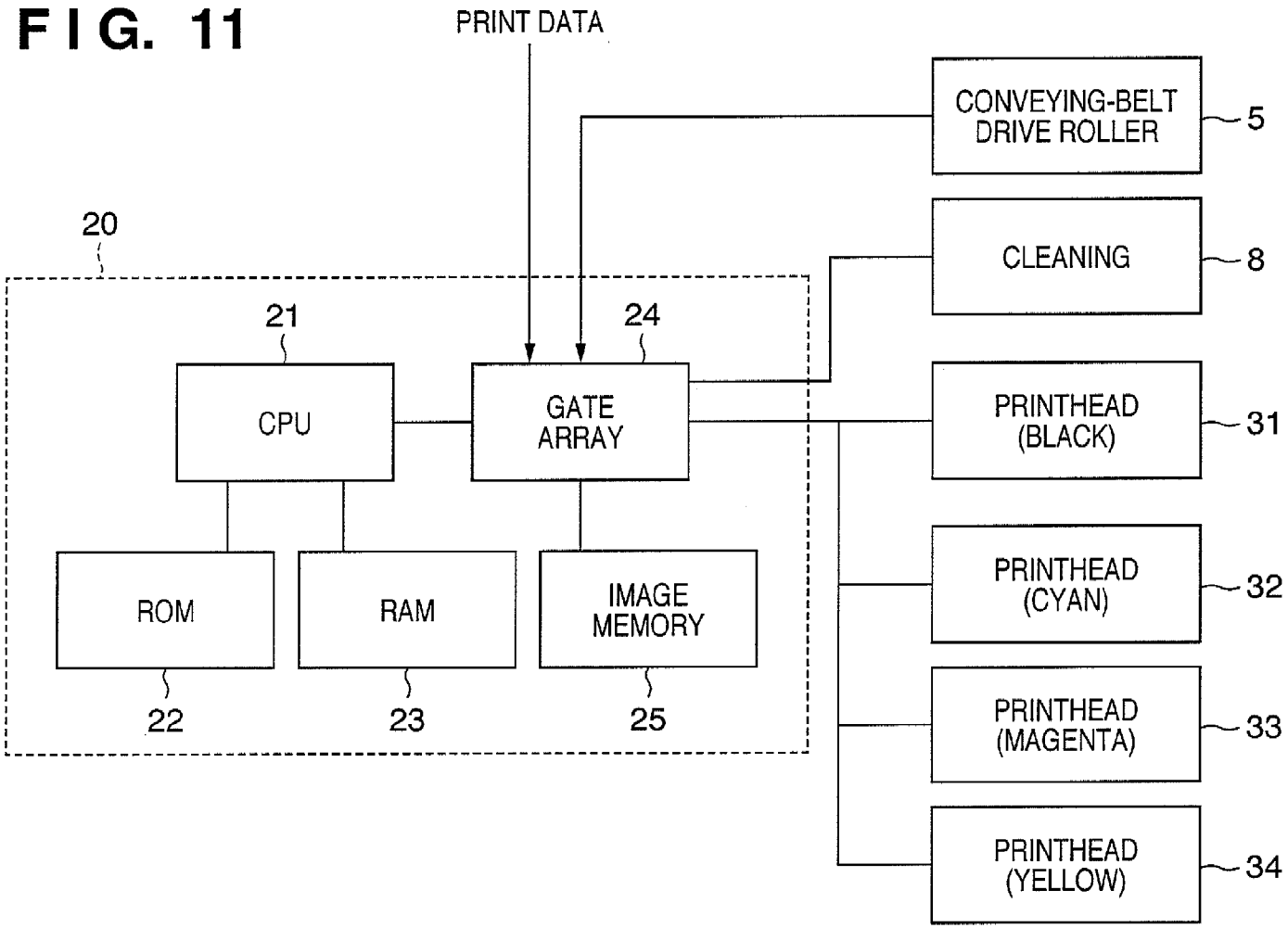
FIG. 11 is a block diagram illustrating the control structure of the inkjet printing apparatus.

FIG. 11 is a block diagram illustrating the control structure of the inkjet printing apparatus. The control structure includes a black printhead 31, cyan printhead 32, yellow printhead 33, magenta printhead 34 and conveying-belt drive roller 5. The printheads 31 to 34 are provided with temperature sensors for sensing the temperatures of the respective printheads. The temperature sensors are placed in the vicinity of the discharge nozzles.

A controller 20 includes a CPU 21, a ROM 22 for storing a program, a RAM 23 for saving work data necessary for control, and a gate array 24. The gate array 24 outputs a signal for controlling the driving of conveying-belt drive roller 5, an image signal and control signal to the printhead 3, a signal for controlling the drive of cleaning mechanism 8 and a pulse-width table value, etc, described later. An image memory 25 temporarily stores print data that the gate array 24 has received from outside.

Figure 12:
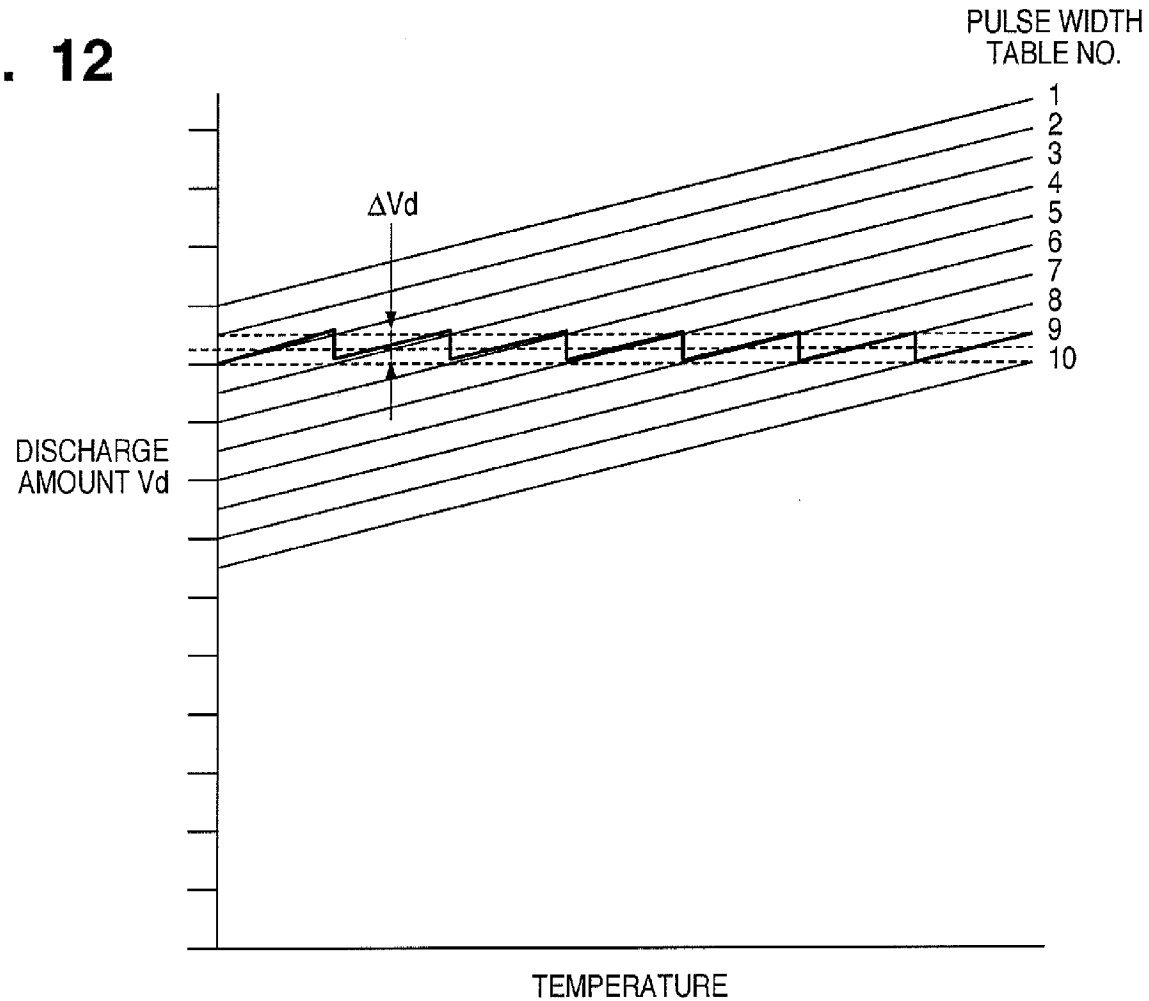
FIG. 12 is a diagram illustrating an example of selection of pulse width tables according to an embodiment of the present invention.

FIG. 12 is a diagram illustrating an example of selection of pulse width tables according to an embodiment of the present invention. This is for holding an ink discharge amount (Vd) constant with respect to the temperature of the printhead. It is possible to set ten types of discharge pulses of Pulse Width Table Nos. 1 to 10 shown in FIG. 13 and control the amount of ink discharge in accordance with the temperature of the printhead in such a manner that the amount of fluctuation in discharge amount will fall within ΔVd, an amount that will not result in image-related problems.

Figure 13:
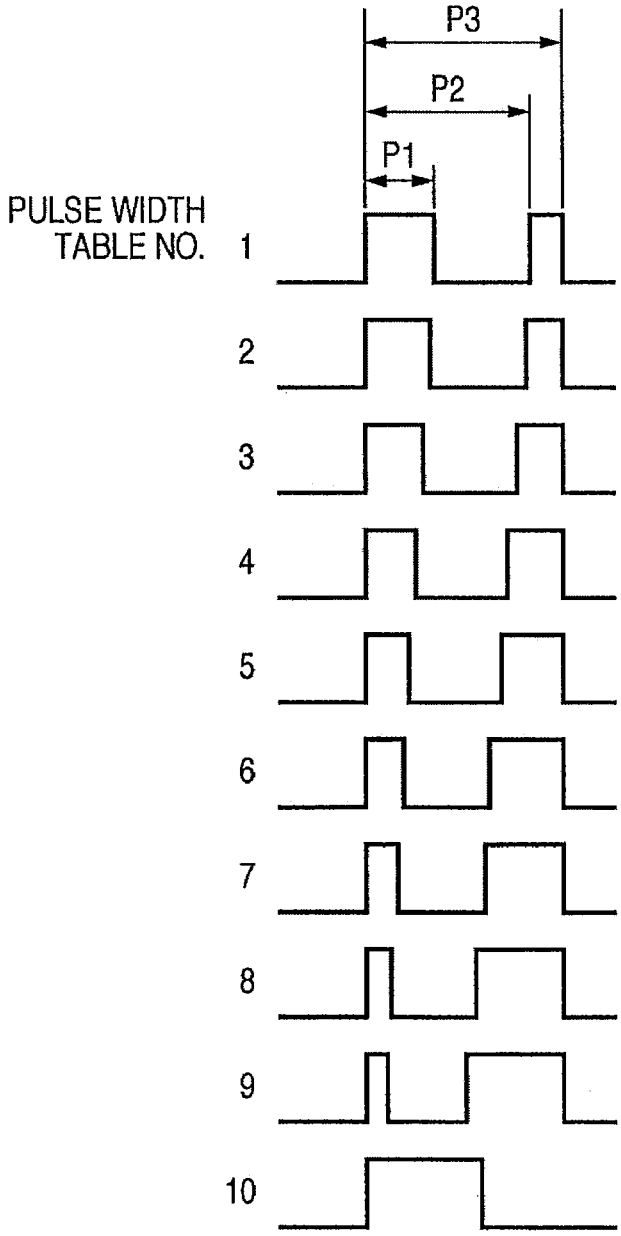
PRIOR ART FIG. 13
FIG. 13 is a diagram illustrating waveforms of discharge pulses.

FIG. 13 diagrammatically illustrates pulse waveforms (Pulse Width Table Nos. 1 to 10) corresponding to actual discharge pulses used in this embodiment. The amount of ink discharge can be controlled by changing the width of a preheating pulse and changing also the width of a main pulse in conformity with the change in the width of the preheating pulse. Here P1, P2 and P3 denote timings (time intervals) for reproducing the pulse waveforms. The values of P1, P2 and P3 are stored in pulse width tables within the ROM 22 and are used upon being expanded in the gate array 24.

Figure 14:
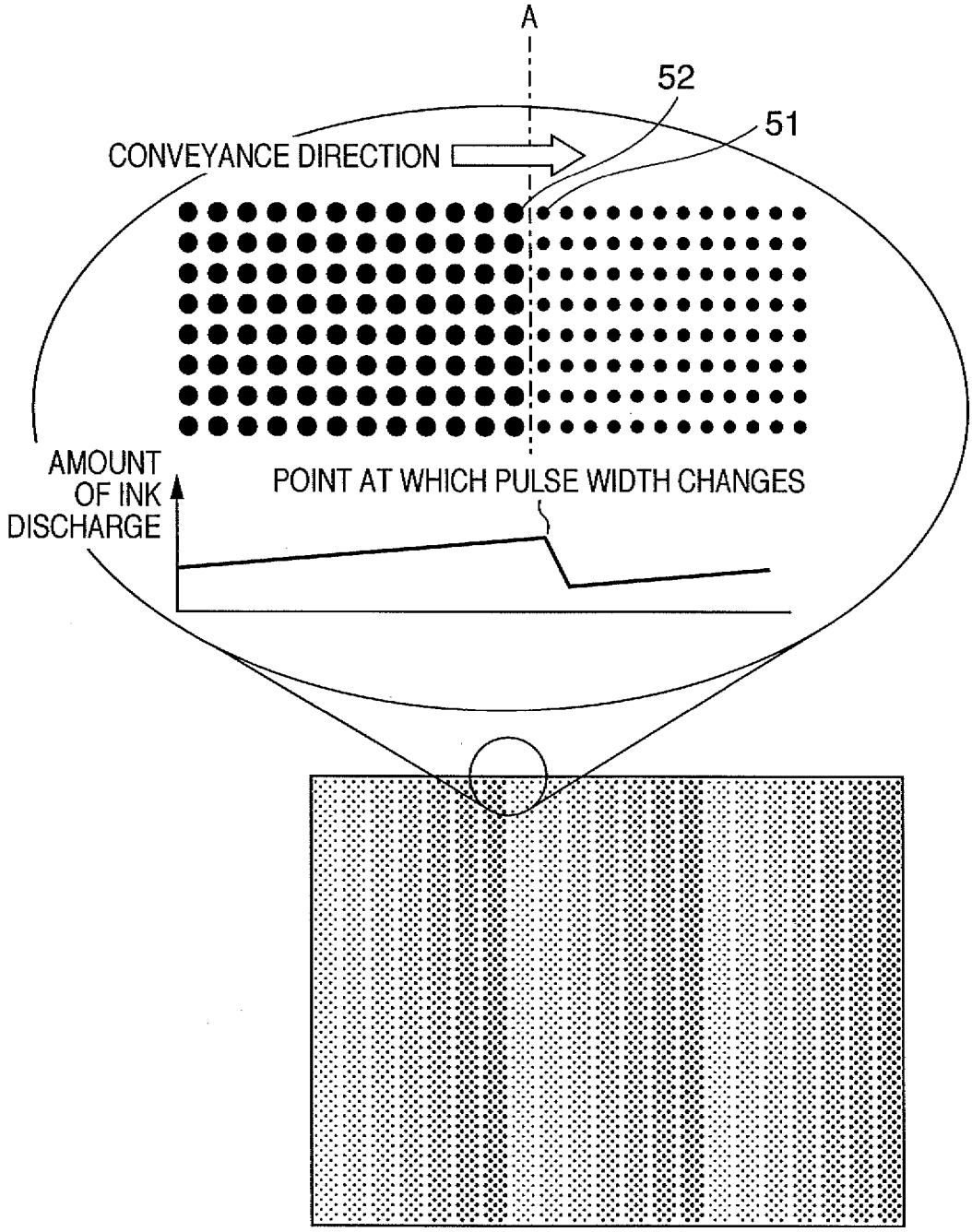
FIG. 14 is a diagram illustrating an image printed upon changing over discharge pulses in mid-course.

When discharge of ink is repeated continuously with this arrangement in actual printing, the temperature of the printhead gradually rises. The discharge of ink from each printing element also gradually rises as a result. Accordingly, if the temperature of the printhead sensed by the temperature sensor exceeds a certain threshold value, a changeover is made to a discharge pulse that will result in a reduced amount of ink discharge. For example, refer to the enlarged view of FIG. 14, which illustrates an image that has been printed with a changeover in discharge pulse in mid-course. Assume that Pulse Width Table No. 7 in FIG. 13 has been used to print up to ink dots in a column of ink dots 52 on the left side of a line segment A in FIG. 14. Then, printing from ink dots in a column of ink dots 51 on the right side of the line segment A is performed upon changing over to Pulse Width Table No. 8. The amount of discharge for the ink dots in the column of ink dots 51 is the same as that of initially printed ink dots (not shown) printed using Pulse Width Table No. 7. However, temperature rises while ink continues to be discharged by the discharge pulses of Pulse Width Table No. 7, and the amount of ink discharge for the ink dots 52 immediately prior to the changeover to the Pulse Width Table No. 8 is slightly greater in comparison with the amount of ink discharge for the ink dots 51. Consequently, the size of the ink dots 52 becomes slightly larger in comparison with the ink dots 51, as illustrated. However, if the difference in amount of ink discharge between that for ink dots 51 and that for ink dots 52 falls within ΔVd shown in FIG. 12, the boundary between these ink dots cannot be distinguished by the human eye and no problems arise in terms of the image.

Figure 6:
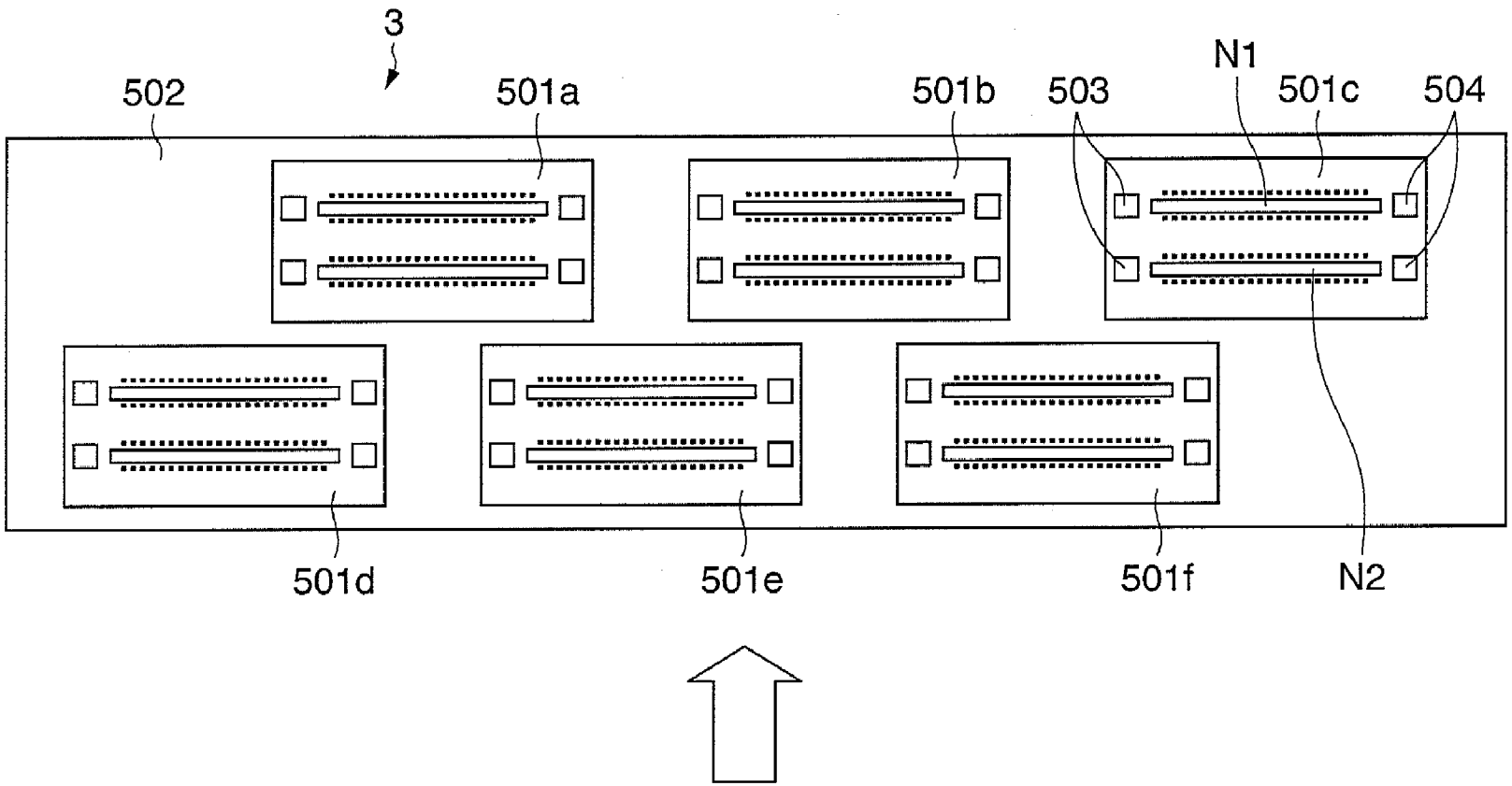
FIG. 6 is a diagram of a printhead as seen from the side of a printing element board.
Figure 7A:
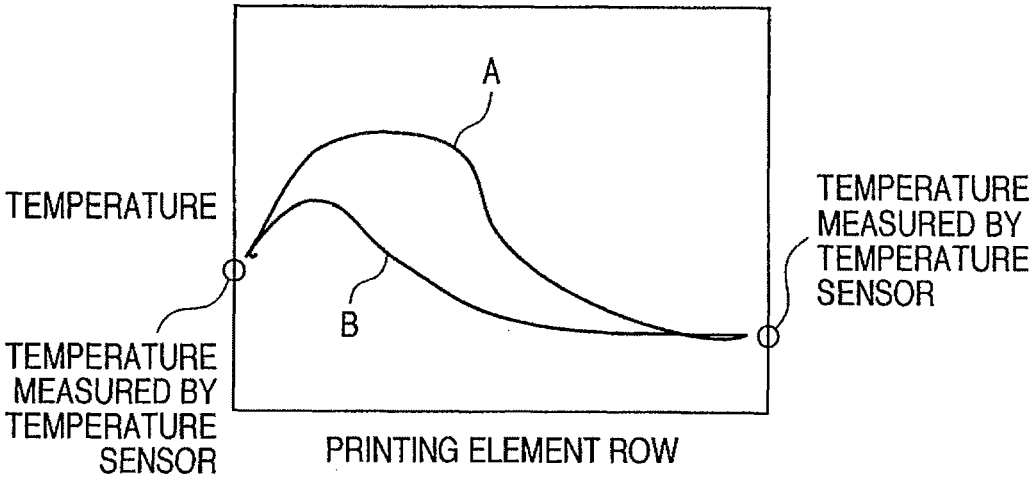
FIGS. 7A to 7C are diagrams illustrating specific images and temperature distributions of a row of printing elements when the images are printed.
Figure 7B:
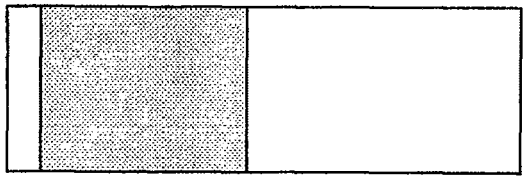
Figure 7C:
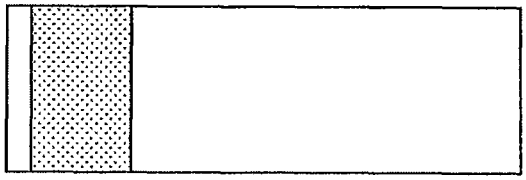
Figure 8:
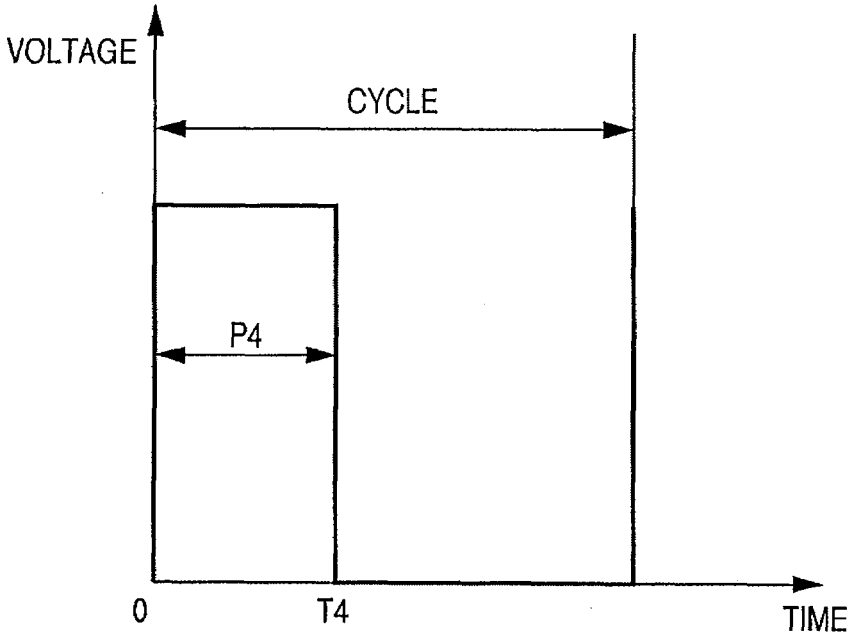
PRIOR ART FIG. 8
FIG. 8 is a diagram illustrating a heating pulse for short-pulse heating.
Figure 9:
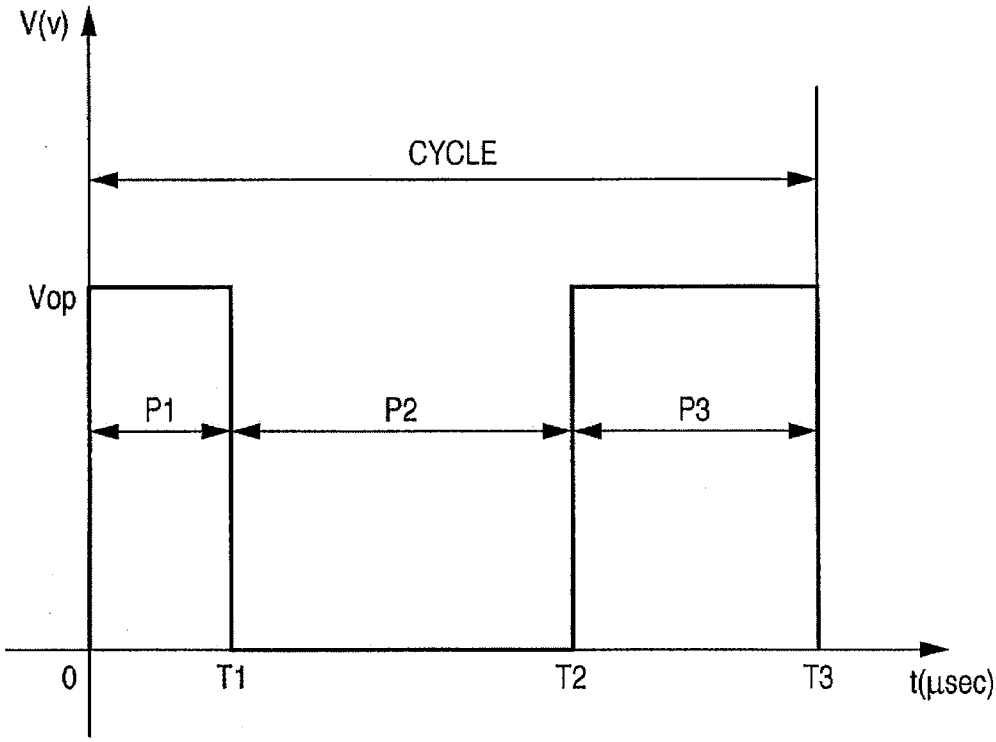
PRIOR ART FIG. 9
FIG. 9 is a time chart of heating pulses applied to a printhead.

FIG. 6 is a diagram of the typical printhead 3, which can be used in this invention, as seen from the side of a printing element board. The printhead 3 is fixed to the inkjet printing apparatus 1 and performs printing while the printing medium is moved in the direction of the arrow in FIG. 6. The printhead 3 has a plurality of printing element boards 501 (501*a* to 501*f*) each of which is equipped with printing element rows N1, N2. The printing element boards are placed in staggered fashion in such a manner that ends of the printing element rows N1, N2 mutually overlap slightly.

Each printing element board 501 is formed by a Si substrate having a thickness of 0.5 to 1 mm, by way of example. A support board 502 consists of alumina ($Al_2O_3$) having a thickness of 3 to 10 mm, by way of example. The material constituting the support board is not limited to alumina and may consist of a material having a coefficient of linear expansion the same as that of the material of the printing element board 501 and a coefficient of thermal conductivity equal to or greater than that of alumina.

Examples of the material of the support board 502 are silicon (Si), carbon graphite, zirconia, silicon nitride ($Si_3N_4$), silicon carbide (SiC), molybdenum (Mo) and tungsten (W). The support board 502 is formed to have an ink supply port (not shown) for supplying the printing element board 501 with ink from an ink tank (not shown). The ink supply port of the printing element board 501 corresponds to an ink supply port (not shown) of the support board 502, and the printing element board 501 is fixedly bonded to the support board 502 with good positional precision. Preferably, the bonding agent should have a low viscosity, the bonding layer thereof formed on the surface of contact should be thin, the hardness thereof after hardening should be comparatively high, and the bonding agent should withstand contact with ink. For example, use may be made of thermally cured bonding agent the main ingredient of which is epoxy resin, or an ultraviolet-curable-type thermally cured bonding agent, and the thickness of this bonding agent layer preferably is less than 50 μm. In view of the fact that heat evolved by printing using the printing element board 501 escapes toward the side of the support board 502, it is especially preferred that the thickness of the bonding agent layer be less than 10 μm.

In addition to the printing element rows N1, N2, temperature sensors 503, 504 formed by diodes or the like are provided on the printing element board 501 on both sides of each printing element row. As illustrated in FIG. 6, the printing element board 501 is provided with four temperature sensors. One is provided on each end of the printing element row N1, and one is provided on each end of the printing element row N2. The arrangement is such that a change in the temperature of each printing element row is sensed by the temperature sensors 503, 504.

Preferably, use is made of such a full-line printhead in which temperature sensors are provided on both sides of each printing element row and the printing element rows are arranged in one direction in such a manner that the ends thereof overlap each other.

FIGS. 1A to 1D illustrate temperature distributions. Here temperature distributions along a printing element row at the end of printing of one page have left-right asymmetry in a case where an image is formed over the entire surface of the print medium.

Here the central portion of the curve "ACTUAL TEMPERATURE DISTRIBUTION" tends to be high, just as before, but the temperature at the left end of the printing element row is lower than the temperature at the right end. For example, the printing element boards 501*a* and 501*d* in FIG. 6 have such a temperature distribution. Although the printing element boards 501*b*, 501*e* are provided adjacent the right side of the printing element boards 501*a* and 501*d*, the left side of the printing element boards 501*a*, 501*d* is the end of the printhead and therefore printing element boards are not provided on this side. Accordingly, although the printing element boards 501*a*, 501*d* are heated from the right side by heat produced from the adjacent printing element boards, they are not heated from the left side. Consequently, the temperature at the left end of the printing element rows of the printing element boards 501*a* and 501*d* is lower than the temperature at the right end. On the other hand, the temperature at the right end of the printing element rows of the printing element boards 501*c* and 501*f* placed at the opposite end of the printhead 3 is lower than the temperature at the left end.

Further, in a case where an image is formed by driving only the printing element boards 501*a* and 501*d* or only one of these is driven, with the adjacent printing element boards 501*b* and 501*e* not being driven, the temperature at the left end of the printing element rows becomes lower than the temperature at the right end, although not to the extent of the case mentioned above. The reason for this is that since the left end of the printing element board 501*a* and 501*d* is the end of the printhead, release of heat into the air is facilitated.

Figure 1A:
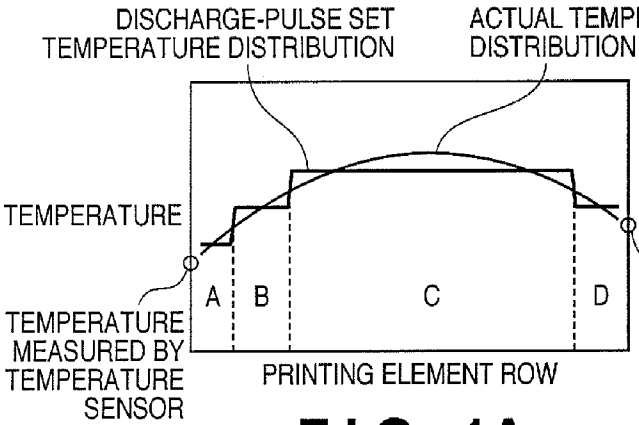
FIGS. 1A to 1D are diagrams illustrating temperature distributions of a row of printing elements in the present invention.
Figure 1B:
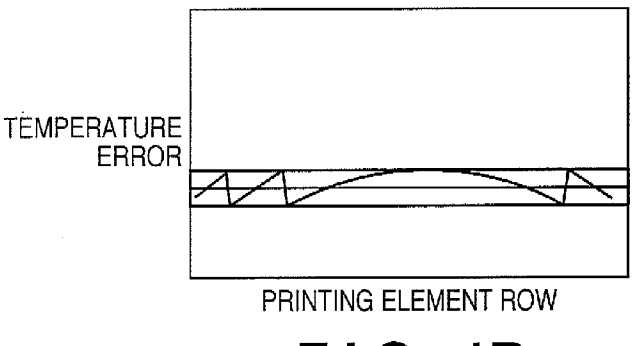
Figure 2A:
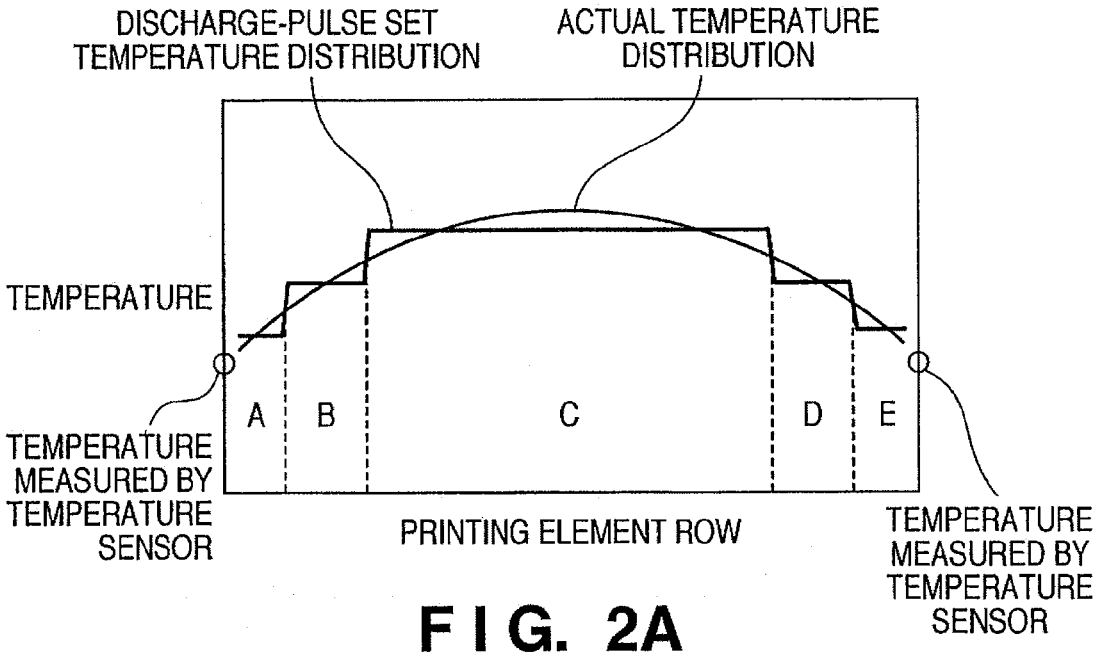
FIGS. 2A and 2B are diagrams illustrating temperature distributions of a row of printing elements.
Figure 2B:
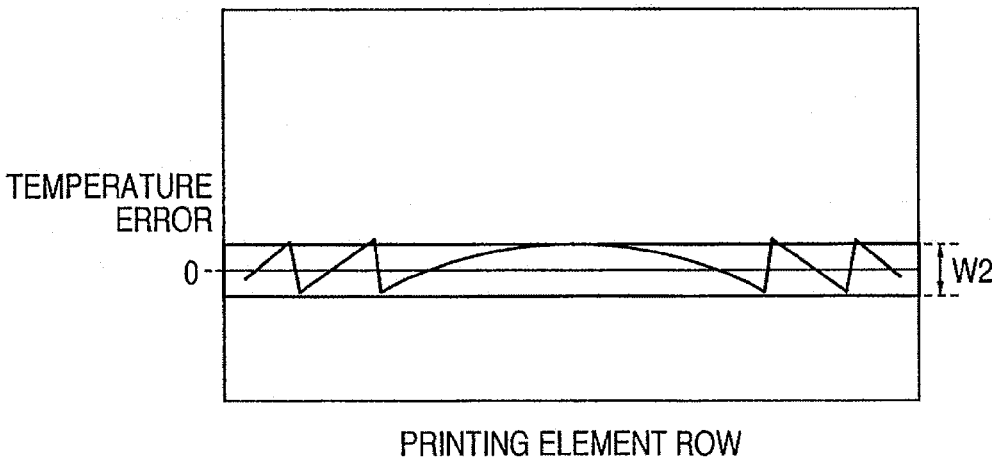
Figure 3A:
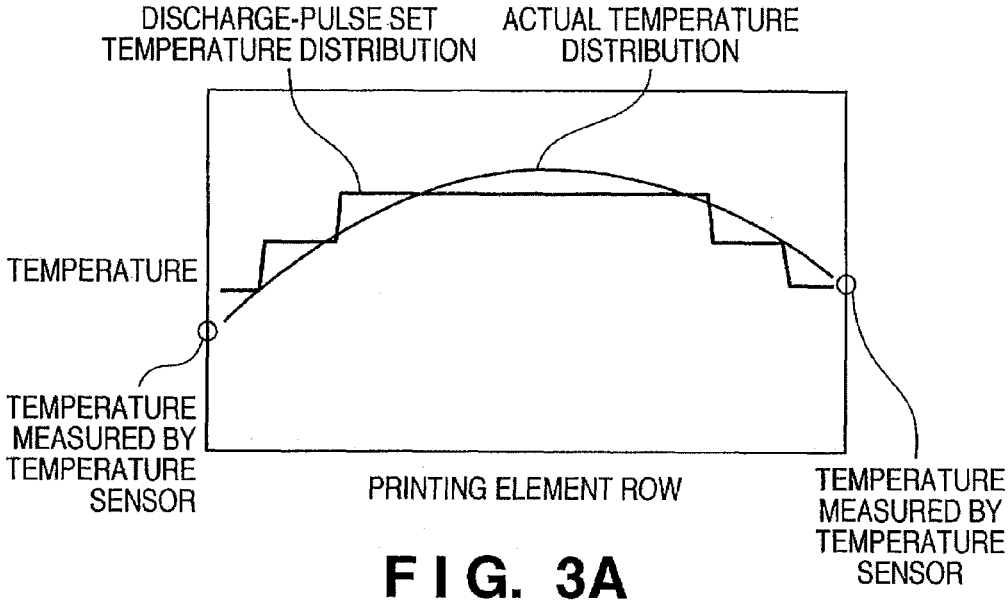
FIGS. 3A and 3B are diagrams illustrating temperature distributions of a row of printing elements.
Figure 3B:
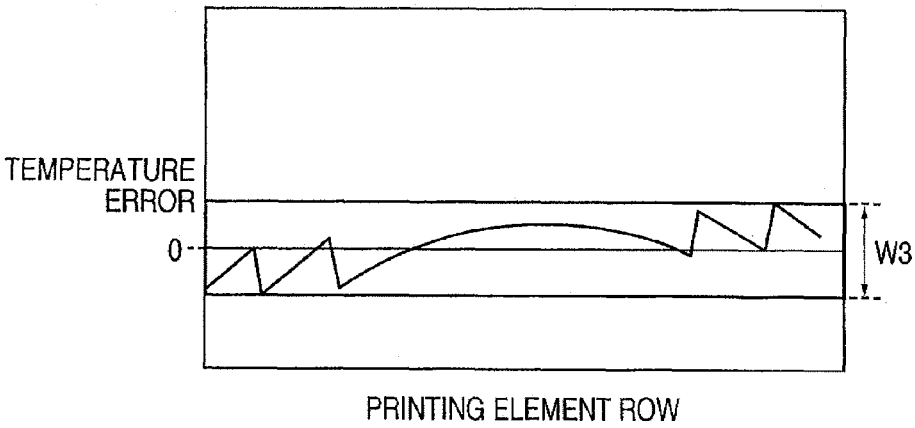

The curve "ACTUAL TEMPERATURE DISTRIBUTION" in a case where an image formed on the entire surface of the medium is divided into four ranges A, B, C, D, as illustrated in FIG. 1A, average temperature of the upper- and lower-limit temperature value of each range is calculated, and the step-shaped line drawing labeled "DISCHARGE-PULSE SET TEMPERATURE DISTRIBUTION" is set. Discharge pulses applied to printing elements in each of the ranges A, B, C, D are decided from the line drawing "DISCHARGE-PULSE SET TEMPERATURE DISTRIBUTION". FIG. 1B is a diagram similar to FIGS. 2B and 3B. Since the temperature error here is almost no different from that in the case of the ideal temperature distribution of FIG. 2B, as illustrated in FIG. 1B, an error in the amount of ink discharge of a printed image can be suppressed and there is not much of a decline in image quality.

Figure 4:
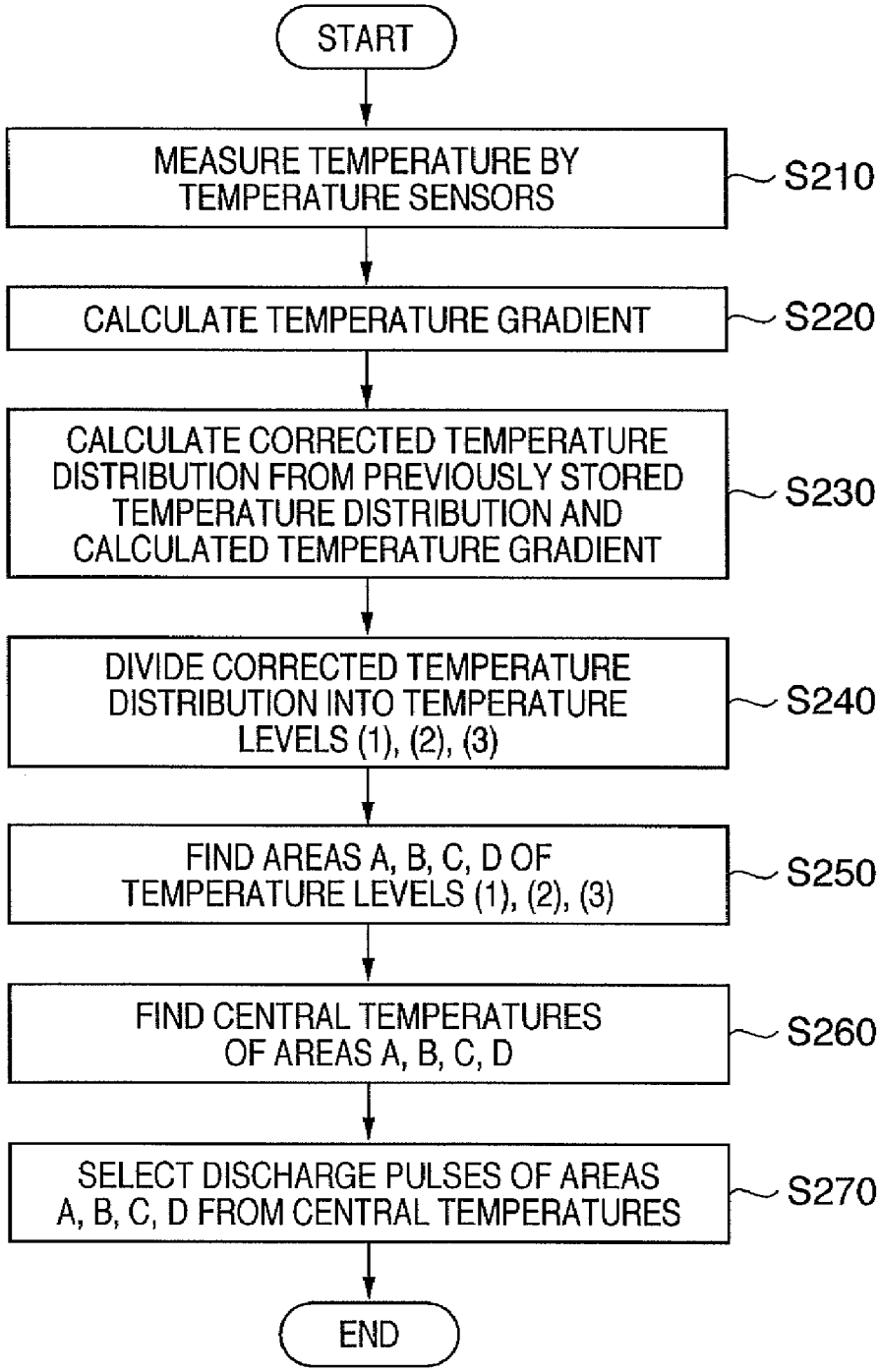
FIG. 4 is a flowchart according to an embodiment of the present invention.

Next, a procedure for setting discharge pulses will be described with reference to FIGS. 1C, 1D and the flowchart of FIG. 4.

Initially, the temperature sensors placed at both ends of a printing element row measure temperature at any time during printing using a printing apparatus in which the temperature distribution along the above-mentioned printing element row assumed when printing was performed has been stored in a ROM, etc., beforehand (step S210). Next, at step S220, the temperature gradient of the printing element row is calculated from the results of measurement by the temperature sensors.

Next, a corrected temperature distribution is calculated and predicted from the previously stored temperature distribution and the temperature gradient calculated at step S220 (step S230). The previously stored temperature distribution is a temperature distribution of the kind depicted in FIG. 2A, by way of example.

Next, the corrected temperature distribution is divided into temperature levels (temperature regions) of three steps (1), (2) and (3) (step S240). More specifically, as illustrated by example in FIG. 1C, it will suffice to find the difference between maximum and minimum temperatures of the corrected temperature distribution and divide this different equally into three portions. For example, the temperature regions (1), (2) and (3) are represented by temperatures T1 to T2, T2 to T3 and T3 to T4, respectively.

Figure 1C:
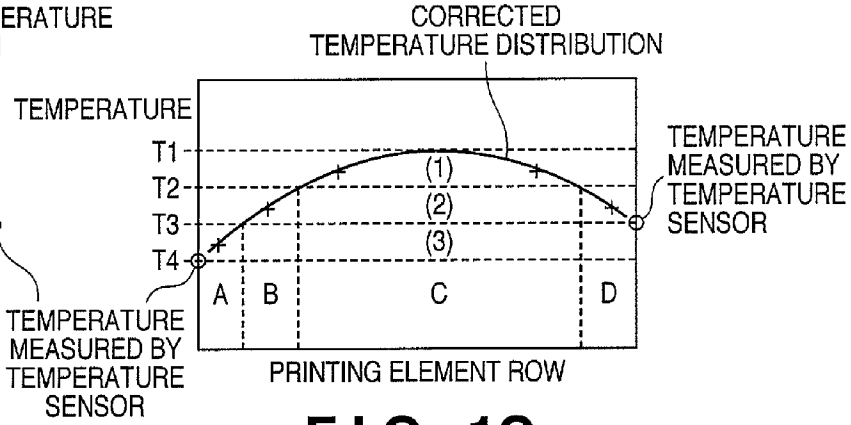
Figure 1D:
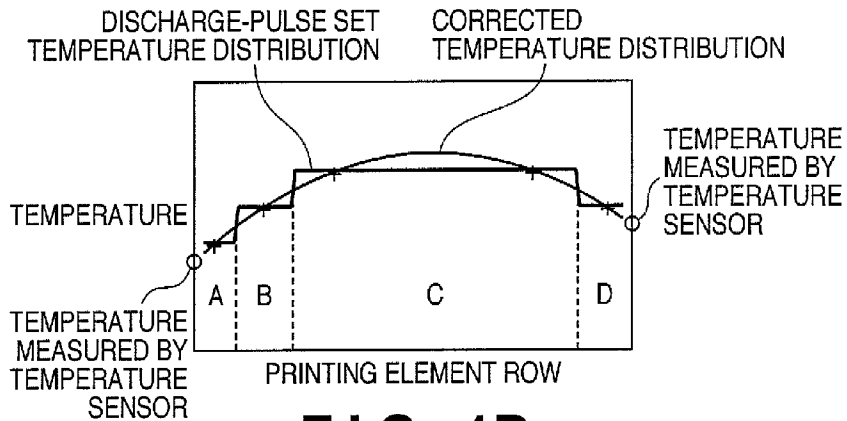

Next, areas A, B, C, D indicating the temperature levels (1), (2), (3) are found from the corrected temperature distribution (step S250), as illustrated in FIGS. 1C and 1D. That is, the row of printing elements is divided into four areas based upon the temperature regions.

The central temperatures of the areas A, B, C, D are found (step S260). The "central temperature" is a temperature at the center of the maximum and minimum temperatures in each region, by way of example.

Finally, discharge pulses of areas A, B, C, D are selected from the central temperatures (S270). In order to obtain a desired amount of ink discharge, a table for every temperature of discharge pulse of the kind shown in FIG. 5 is set in advance and discharge pulses are selected from the tables on a per-discharge-element basis. For example, when the temperature is 37° C., Discharge Pulse No. 5 is selected. It should be noted that the units in which discharge pulses are selected may be in units of multiple printing elements. For example, the same discharge pulse may be selected for four consecutive printing elements.

In accordance with the method described above, a temperature distribution close to the actual temperature distribution can be found even if there is a difference between measured temperatures from temperature sensors on both sides of a row of printing elements. As a result, an error in amount of ink discharge can be minimized.

It should be noted that although the embodiment set forth above has been described using a printhead having a plurality of printing element boards, the present invention is applicable also to an inkjet printing apparatus equipped with a printhead having only one printing element board.

Further, in this embodiment, a temperature distribution is divided into temperature levels (temperature regions) of three steps and a row of printing elements is divided into four areas based upon the temperature regions. However, the number of divisions is not limited to this value.

The number and placement of the sensors shown in FIG. 6 may be other than described above. For example, it does not matter if two is the number of temperature sensors provided on the printing element board 501. In this case, one temperature sensor is provided on the left end and one on the right end of the printing element board 501, and these are used conjointly to measure the temperature of the printing element row N1 and the temperature of the printing element row N2.

Further, in order to reduce the temperature difference between a printing element used in printing and a printing element not used in printing, it is permissible to adopt an arrangement further provided with control means which, during printing, applies heating pulses of pulse widths in a range that will not cause discharge of ink to printing elements not used in printing. If this arrangement is adopted, the accuracy with which a corrected temperature distribution is calculated rises and an error in amount of ink discharge can be suppressed further.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-336368, filed on Dec. 13, 2006, which is hereby incorporated by reference herein in its entirety.

What is claimed is:

1. An inkjet printing apparatus having a printhead equipped with printing element row that includes printing elements having a plurality of heat-producing resistance elements, comprising:

a temperature sensing unit, which is provided at least on both sides of the printing element row in the array direction thereof and senses the temperature of the printhead;

a temperature distribution storage unit in which a temperature distribution along the printing element row assumed when printing has been performed by driving the printing elements has been stored in advance;

a temperature gradient calculating unit which calculates the temperature gradient of the printing element row from the temperature of the printhead sensed by said temperature sensing units;

a predicting unit which predicts the temperature of each printing element using the temperature gradient calculated by said temperature gradient calculating unit and the temperature distribution along the printing element row stored in said temperature distribution storage unit in advance; and a control unit which applies discharge pulses, which are decided based upon the predicted temperature from said predicting unit, to each of the printing elements.

2. The apparatus according to claim 1, wherein said control unit applies discharge pulses that differ for each of a plurality of predetermined temperature ranges to each of the printing elements.

3. The apparatus according to claim 2, wherein said control unit applies discharge pulses that differ in accordance with central temperatures of the temperature ranges to each of the printing elements.

4. The apparatus according to claim 1, wherein said control unit applies pulses for heating printing elements that are not used in printing at the time of printing.

5. The apparatus according to claim 1, wherein the printhead is constructed by arranging a plurality of the printing element rows in one direction in such a manner that ends of the printing element rows overlap each other.

6. An inkjet printing method using an inkjet printing apparatus having a printhead equipped with printing element row that includes printing elements having a plurality of heat-producing resistance elements, a temperature sensing unit, which is provided at least on both sides of the printing element row in the array direction thereof and senses the temperature of the printhead, and a storage unit in which a plurality of discharge pulses for being applied to the printing elements have been stored in advance, said method comprising the steps of:

previously storing a temperature distribution along the printing element row assumed when printing has been performed by driving the printing elements;

sensing the temperature of the printhead by the temperature sensing unit;

calculating the temperature gradient of the printing element row from the temperature of the printhead sensed at said step of sensing temperature;

predicting the temperature of each printing element using the temperature gradient calculated at said step of calculating temperature gradient and the temperature distribution along the printing element row stored at said step of previously storing temperature distribution; and applying discharge pulses, which are decided based upon the predicted temperature predicted at said step of predicting temperature, to each of the printing elements.

* * * * *